US009847169B2

(12) United States Patent
Kano et al.

(10) Patent No.: US 9,847,169 B2
(45) Date of Patent: Dec. 19, 2017

(54) METHOD OF PRODUCTION RARE-EARTH MAGNET

(71) Applicant: TOYOTA JIDOSHA KABUSHIKI KAISHA, Toyota-shi, Aichi-ken (JP)

(72) Inventors: Akira Kano, Toyota (JP); Dai Kobuchi, Nagoya (JP); Eisuke Hoshina, Toyota (JP); Osamu Yamashita, Toyota (JP); Noritaka Miyamoto, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 295 days.

(21) Appl. No.: 14/781,425

(22) PCT Filed: Mar. 31, 2014

(86) PCT No.: PCT/IB2014/000450

§ 371 (c)(1),
(2) Date: Sep. 30, 2015

(87) PCT Pub. No.: WO2014/162189

PCT Pub. Date: Oct. 9, 2014

(65) Prior Publication Data

US 2016/0055968 A1 Feb. 25, 2016

(30) Foreign Application Priority Data

Apr. 1, 2013 (JP) ..... 2013-076056

(51) Int. Cl.
*C22C 33/02* (2006.01)
*B22F 3/02* (2006.01)
(Continued)

(52) U.S. Cl.
CPC ..... *H01F 41/0266* (2013.01); *C21D 6/007* (2013.01); *C21D 8/005* (2013.01);
(Continued)

(58) Field of Classification Search
CPC ..... H01F 41/0266; H01F 41/0273; H01F 1/0576; H01F 1/08; B22F 3/02;
(Continued)

(56) References Cited

U.S. PATENT DOCUMENTS

2006/0005898 A1* 1/2006 Liu ..... B82Y 25/00 148/105

FOREIGN PATENT DOCUMENTS

JP 02-250922 A 10/1990
JP 04-134804 A 5/1992

* cited by examiner

*Primary Examiner* — Colleen Dunn
*Assistant Examiner* — Anthony Liang
(74) *Attorney, Agent, or Firm* — Sughrue Mion, PLLC

(57) ABSTRACT

A production method includes producing a rare-earth magnet precursor (S') by performing first hot working in which, in two side surfaces of a sintered body, which are parallel to a pressing direction and are opposite to each other, one side surface is brought to a constrained state to suppress deformation, and the other side surface is brought to an unconstrained state to permit deformation; and producing a rare-earth magnet by performing second hot working in which, in two side surfaces (S'1, S'2) of the rare-earth magnet precursor (S'), which are parallel to the pressing direction, a side surface (S'2), which is in the unconstrained state in the first hot working, is brought to the constrained state to suppress deformation, and a side surface (S'1), which is in the constrained state in the first hot working, is brought to the unconstrained state to permit deformation.

5 Claims, 8 Drawing Sheets

(51) Int. Cl.

| | |
|---|---|
| ***H01F 41/02*** | (2006.01) |
| ***H01F 1/057*** | (2006.01) |
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/10*** | (2006.01) |

(52) U.S. Cl.
CPC ..... *C21D 8/1211* (2013.01); *C21D 8/1216* (2013.01); *C22C 38/002* (2013.01); *C22C 38/005* (2013.01); *C22C 38/10* (2013.01); *H01F 1/0576* (2013.01); *H01F 1/0577* (2013.01)

(58) Field of Classification Search
CPC ..... B22F 3/14; B22F 3/17; B22F 2999/00; B22F 2998/10; C22C 33/02; C22C 38/002; C22C 38/005; C22C 2202/02
See application file for complete search history.

METHOD OF PRODUCTION RARE-EARTH MAGNET

BACKGROUND OF THE INVENTION

1. Field of the Invention

The invention relates to a method of producing a rare-earth magnet that is an oriented magnet, by hot working.

2. Description of Related Art

A rare-earth magnet using a rare-earth element such as lanthanoid is also called a permanent magnet. The rare-earth magnet has been used for a drive motor of a hybrid car or an electric vehicle in addition to a hard disk and a motor that constitutes an MRI.

As an index of a magnetic performance of the rare-earth magnet, residual magnetization (a residual magnetic flux density) and a coercive force may be exemplified. With an increase in amount of heat generation due to reduction of the size of a motor or an increase in the current density of a motor, demand for heat resistance of the used rare-earth magnet is further increasing. Accordingly, maintaining the magnetic properties of the magnet when the magnet is used under high-temperature is important.

Here, an example of a method of producing the rate-earth magnet in related art will be schematically illustrated with reference to FIGS. 8A and 8B and FIGS. 9A and 9B. In addition, FIGS. 8A and 8B are diagrams illustrating hot working in related art. Here, FIG. 8A is a schematic perspective diagram of a sintered body before the hot working (hot plastic working), and FIG. 8B is a schematic perspective diagram of the rare-earth magnet after the hot working. FIGS. 9A and 9B are explanatory diagrams of hot working in the related art. FIG. 9A is a longitudinal sectional diagram illustrating a relationship between a friction force that acts on the sintered body and a plastic flow during hot working, and FIG. 9B is a diagram illustrating a strain distribution of the rare-earth magnet in a longitudinal section CS of the rare-earth magnet in the related art shown in FIG. 8B.

First, for example, a fine powder, which is obtained by rapid solidification of Nd—Fe—B-based molten metal, is subjected to pressure forming to produce a sintered body Z shown in FIG. 8A. Next, the sintered body Z is subjected to hot working to produce a rare-earth magnet X shown in FIG. 8B. In the method of producing the rare-earth magnet X in the related art; a pressure is applied to an upper surface Z3 and a lower surface Z4 during hot working for the sintered body Z to compress the sintered body Z in an upper-lower direction that is a pressing direction, thereby causing a plastic flow in a horizontal direction perpendicular to the pressing direction. As a result, plastic deformation occurs.

At this time, when right and left side surfaces Z2, Z1 of the sintered body Z are in an unconstrained state and front and rear side surfaces Z5, Z6 of the sintered body Z are in a constrained state, the plastic flow is caused in the sintered body Z from the center in the right-left direction, whereby the right and left side surfaces Z2, Z1 are deformed. At this time, an upper surface Z3 and a lower surface Z4 of the sintered body Z are constrained by punches that apply a pressure thereto. When the sintered body Z, in which the upper surface Z3 and the lower surface Z4 are set in a constrained state due to the pressure applied by the punches as described above, begins to deform in the right-left direction, a frictional force acts on the constrained upper surface Z3 and lower surface Z4.

As shown in FIG. 9A, the frictional force F, which acts on the upper surface Z3 and the lower surface Z4 of the sintered body Z, is largest at the central portion CP in the right-left direction in which the sintered body Z is deformed, and the frictional force F decreases toward the right and left side surfaces Z2, Z1 of the sintered body Z. The frictional force F acts to hinder the plastic flow PF of the sintered body Z in the right-left direction. Accordingly, the plastic flow PF is less likely to occur (i.e., the ease, with which the plastic flow PF occurs, decreases) toward the central portion CP from the right and left side surfaces Z2, Z1 of the sintered body Z.

In addition, an effect of the friction force F on the plastic flow PF decreases toward the center of the inside of the sintered body Z in the pressing direction, that is, toward an intermediate portion between the upper surface Z3 and the lower surface Z4 from the constrained upper surface Z3 and lower surface Z4 of the sintered body Z. Accordingly, the plastic flow PF is more likely to occur (i.e., the ease, with which the plastic flow PF occurs, increases) toward the center of the inside of the sintered body Z in the pressing direction from the constrained upper and lower surfaces Z3, Z4 of the sintered body Z.

Accordingly, as shown in FIGS. 8A and 8B, when a pressure is applied to the upper surface Z3 and the lower surface Z4 of the sintered body Z to perform compression in the upper-lower direction while the right and left side surfaces Z2, Z1 of the sintered body Z are in the unconstrained state, a difference in the plastic flow is caused in a section CS that is parallel to the right-left direction and to the pressing direction. As a result, as shown in FIG. 9B, a strain in the section CS of the rare-earth magnet X that is produced becomes non-uniform. A non-uniform strain distribution is a factor for deteriorating magnetic properties of the rare-earth magnet X that is produced. Accordingly, it is necessary to prevent occurrence of the non-uniform strain distribution during production of a rare-earth magnet by the hot working.

As an example of the hot working in a process of producing the rare-earth magnet, Japanese Patent Application Publication No. 4-134804 (JP 4-134804 A) discloses a technology in which a cast alloy of a magnet is placed in a capsule, and die forging is performed at a temperature equal to or higher than 500° C. and equal to or lower than 1100° C. to make the alloy be magnetically anisotropic. In JP 4-134804A, when performing the hot working for the capsule using a forging machine, multi-stage forging is performed by placing the capsule in two or more kinds of dies. Thus, even in a thin capsule, it is possible to apply a pressure like a hydrostatic pressure to the inside of the forged alloy while causing plastic deformation in the cast alloy as in free forging. Accordingly, it is possible to prevent the magnet from being broken.

In a case where side surfaces of the sintered body are not constrained by dies as in JP 4-134804 A, the frictional force is largest at the central portions in the upper and lower surfaces. In addition, the effect of the frictional force is small at the central portion between the upper and lower surfaces of the sintered body, as compared to the vicinity of the upper and lower surfaces of the sintered body, and thus a relatively free plastic flow occurs at the central portion between the upper and lower surfaces of the sintered body, as compared to the vicinity of the upper and lower surfaces of the sintered body.

As a result, a difference in a strain amount in a lateral direction and a pressing direction is caused in the sintered body due to a difference in material flowability, and thus a strain distribution of a magnet becomes non-uniform in a section of the sintered body, which is parallel to the pressing direction. As the degree of working for the sintered body (the compression rate of the sintered body) increases, a difference in the strain amount between the vicinity of a surface of the magnet and the inside of the magnet increases. As a result, for example, when strong working in which the compression rate of the sintered body is approximately 10% or higher is performed, the strain distribution in a sectional direction of the magnet becomes significantly non-uniform. The non-uniform strain distribution is a factor for decreasing residual magnetization of the magnet.

On the other hand, Japanese Patent Application Publication No. 2-250922 (JP 2-250922 A) discloses a technology in which a rare-earth alloy ingot is placed in a metal capsule, hot rolling is performed at a rolling temperature equal to or higher than 750° C. and equal to or lower than 1150° C. in a state in which the alloy ingot includes a liquid phase, and hot rolling is performed in two or more passes so that a total working rate is 30% or higher. In JP 2-250922 A, rolling is performed while applying constraint from both sides of the metal capsule in a width direction. Thus, spreading in the width direction is suppressed during rolling of the alloy ingot. Accordingly, it is possible to obtain an appropriate crystal axis orientation in a width direction and a longitudinal direction of a long plate material that is obtained by the rolling.

However, in JP 2-250922 A, the metal capsule is not constrained in a longitudinal direction, and thus, almost all of a volume reduction due to a reduction of the metal ingot results in spreading in the longitudinal direction. Therefore, in a case where a plate material obtained by the rolling is a plate material having a predetermined length, and the plate material is not a continuous band plate, there is a possibility that the non-uniform strain distribution as described above may occur in a section along the longitudinal direction of the plate material. As described above, in the technologies disclosed in JP 4-134804 A and JP 2-250922 A, it may not be possible to prevent occurrence of the non-uniform strain distribution when the rare-earth magnet is produced through the hot working.

SUMMARY OF THE INVENTION

The invention relates to a method of producing a rare-earth magnet through hot working, and provides the method of producing a rare-earth magnet, which improves residual magnetization by making strain distribution uniform.

An aspect of the invention relates to a method of producing a rare-earth magnet. The method includes accommodating a sintered body, which is obtained by sintering a rare-earth magnet material, in a forming mold which is constituted by upper and lower punches and a die and in which at least one of the upper and lower punches is slidable in a hollow inside of the die, and producing a rare-earth magnet precursor by performing first hot working in which, in two side surfaces of the sintered body, which are parallel to a pressing direction and are opposite to each other, one side surface is caused to come into contact with an inner surface of the die and is brought to a constrained state to suppress deformation, and the other side surface is not caused to come into contact with the inner surface of the die and is brought to an unconstrained state to permit deformation when upper and lower surfaces of the sintered body are pressed by using the upper and lower punches; and moving the rare-earth magnet precursor in the forming mold, and producing a rare-earth magnet by performing second hot working in which, in two side surfaces of the rare-earth magnet precursor, which are parallel to the pressing direction, a side surface, which is in the unconstrained state in the first hot working, is caused to come into contact with the inner surface of the die and is brought to the constrained state to suppress deformation, and a side surface, which is in the constrained state in the first hot working, is brought to the unconstrained state to permit deformation when upper and lower surfaces of the rare-earth magnet precursor are pressed by using the upper and, lower punches.

In the method of producing a rare-earth magnet according to the above-mentioned aspect of the invention, the sintered body, which is obtained by sintering and solidifying a rare-earth magnet material such as a magnet powder produced by, for example, a liquid quenching method, is subjected to hot working to obtain a desired shape and to give magnetic anisotropy.

The shape of the sintered body is not particularly limited. However, for example, a hexahedron such as a cube and a rectangular parallelepiped may be used. The planar shape of the sintered body may be a polygon other than a rectangular shape, and may be a circular shape or an elliptical shape. Even when the planar shape of the sintered body is a circular shape or an elliptical shape, for example, two side surfaces, which are opposite to each other, are present in a section parallel to a sintered body pressing direction. In addition, the sintered body may be a polyhedron other than the hexahedron, and the sintered body may have a shape with a rounded corner or ridge, or may have a curved side surface that swells in a, lateral direction.

The term "upper and lower" in the invention is used for orientation for convenience to clarify a positional relationship in each configuration, and therefore, the "upper and lower" does not always represent "upper and lower" in a vertical direction. In addition, the terms "lateral direction" and "right and left" are used for orientation in a relationship with the term "upper and lower", and the terms do not always represent a horizontal direction. Accordingly, the invention does not exclude, for example, a configuration in which the upper and lower punches are arranged in a horizontal direction.

When the upper and lower surfaces are pressed by the upper and lower punches during hot working on the sintered body, the sintered body is compressed in the pressing direction, and a plastic flow occurs in a direction perpendicular to the pressing direction, whereby plastic deformation occurs. At this time, if the two side surfaces, which are parallel to the upper-lower pressing direction and are opposite to each other, are not in contact with the inner surface of the die and are in an unconstrained state as in related art, these two side surfaces are deformed in a lateral direction toward the outside of the sintered body. At this time, the upper and lower surfaces of the sintered body are constrained due to contact with the punches that press these surfaces. Thus, when the sintered body, in which the upper and lower surfaces are in the constrained state, is deformed in the lateral direction, a frictional force in the lateral direction acts on the constrained upper and lower surfaces.

The frictional force in the lateral direction, which acts on the upper and lower surfaces of the sintered body, is largest at the central portions of the upper and lower surfaces of the sintered body, and decreases toward both side surfaces of the sintered body, which are in the unconstrained state. The frictional force acts to hinder the plastic flow of the sintered body in the lateral direction. Accordingly, the plastic flow is less likely to occur (i.e., the ease, with which the plastic flow occurs, decreases) toward the central portion of the sintered body from both side surfaces of the sintered body, which are in the unconstrained state.

With regard to the sintered body pressing direction, an effect of the frictional force on the plastic flow of the sintered body decreases toward the internal center of the sintered body, that is, an intermediate portion between the upper and lower surfaces from the constrained upper and lower surfaces of the sintered body. Accordingly, the plastic flow of the sintered body is more likely to occur (i.e., the ease, with which the plastic flow of the sintered body occurs, increases) toward the internal center of the sintered body from the constrained upper and lower surfaces of the sintered body.

Accordingly, if the upper and lower surfaces of the sintered body are pressed while the two side surfaces, which are parallel to the sintered body pressing direction and are opposite to each other, are in the unconstrained state, a difference in the plastic flow is caused due to the effect of the frictional force, in a section of the sintered body, which is parallel to the sintered body pressing direction and is parallel to a direction in which the two side surfaces are opposite to each other. As a result, a strain distribution in the section becomes non-uniform. The non-uniform strain distribution is a factor for decreasing magnetic properties of the rare-earth magnet that is produced.

Accordingly, in the method of producing a rare-earth magnet according to the above-mentioned aspect of the invention, the first hot working is performed, and then, the second hot working is performed. The strain distribution of the rare-earth magnet is made uniform by the two-stage hot working. In addition, a forming mold that is used in the first hot working and a forming mold that is used in the second hot working may be the same, or may be different from each other.

In the first hot working, when the upper and lower surfaces of the sintered body are pressed by using the upper and lower punches, in the two side surfaces of the sintered body, which are parallel to the pressing direction and are opposite to each other, one side surface is caused to come into contact with the inner surface of the die and is brought to the constrained state, and the other side surface is not caused to come into contact with the inner surface of the die and is brought to the unconstrained state.

For example, in a case where the sintered body is a rectangular parallelepiped, there are the following four cases regarding the constrained/unconstrained states of the side surfaces. The four cases include a first case in which one side surface is in the constrained state and the other three side surfaces are in the unconstrained state, a second case in which three side surfaces are in the constrained state and one side surface is in the unconstrained state, a third case in which two adjacent side surfaces are in the constrained state and the other two adjacent side surfaces are in the unconstrained state, and a fourth case in which a pair of opposite side surfaces is in the constrained state, and the other pair of opposite side surfaces is in the unconstrained state.

In a case where the sintered body is a rectangular parallelepiped and the case regarding the constrained/unconstrained states of the side surfaces is the first to third cases, the following relationship is satisfied. That is, in the two side surfaces, which are parallel to the sintered body pressing direction and are opposite to each other, one side surface is brought to the constrained state, and the other side surface is brought to the unconstrained state. For example, in the first case and the second case, a pair of opposite side surfaces satisfies the above-described relationship. In the third case, two pairs of opposite side surfaces satisfy the above-described relationship. However, in the fourth case, side surfaces that satisfy the above-described relationship are not present.

The upper and lower surfaces of the sintered body, which are in a half-constrained state in order for the two opposite side surfaces to satisfy the above-described relationship, are pressed by the upper and lower punches in the first hot working. In this case, the sintered body is compressed in the upper-lower pressing direction, and the side surfaces are apt to be deformed due to the plastic flow in the lateral direction toward the outside of the sintered body. At this time, deformation in the lateral direction is suppressed in one side surface of the two opposite side surfaces of the sintered body, and the deformation in the lateral direction is permitted in the other side surface that is in the unconstrained state.

Since one side surface of the two opposite side surfaces of the sintered body is constrained, the frictional force that acts on the upper and lower surfaces of the sintered body increases toward the side surface in the constrained state. In addition, the frictional force decreases toward the side surface in the unconstrained state from the side surface in the constrained state. Therefore, the plastic flow is hindered to a larger degree due to the frictional force at a location closer to the side surface in the constrained state. Further, the vicinity of the side surface of the sintered body, which is in the constrained state, is compressed in a state in which the plastic flow in the lateral direction toward the outside of the sintered body is suppressed due to contact with the die. As a result, the vicinity of the side surface of the sintered body, which is in the constrained state, is uniformly compressed in the pressing direction, and thus the strain distribution of the produced rare-earth magnet precursor is more uniform, as compared to the related art.

In the second hot working, the rare-earth magnet precursor is relatively moved in the forming mold, and the upper and lower surfaces of the rare-earth magnet precursor are pressed by the upper and lower punches. At this time, in two side surfaces of the rare-earth magnet precursor, which are parallel to the pressing direction, a side surface, which is in the unconstrained state in the first hot working, is caused to come into contact with the inner surface of the die and is brought to the constrained state, and a side surface, which is in the constrained state in the first hot working, is not caused to come into contact with the inner surface of the die and is brought to the unconstrained state.

For example, in a case where the shape of each of the sintered body and the rare-earth magnet precursor is a rectangular parallelepiped, and one side surface of the sintered body is in the constrained state and the other three side surfaces are in the unconstrained state in the first hot working, one side surface of the rare-earth magnet precursor, which is in the constrained state in the first hot working, is brought to the unconstrained state, and among the other three side surface which are in the unconstrained state in the first hot working, a side surface, which is opposite by 180° to the side surface that is in the constrained state in the first hot working, is brought to the constrained state.

Similarly, in a case where three side surfaces of the sintered body are in the constrained state and one side surface is in the unconstrained state in the first hot working, among the three side surfaces of the rare-earth magnet precursor, which are in the constrained state in the first hot working, a side surface, which is opposite by 180° to the side surface that is in the unconstrained state in the first hot working, is brought to the unconstrained state, and one side surface, which is in the unconstrained state in the first hot working, is brought to the constrained state.

Similarly, in a case where two adjacent side surfaces of the sintered body are in the constrained state and the other two adjacent side surfaces are in the unconstrained state in the first hot working, in the two side surfaces of the rare-earth magnet precursor, which are in the constrained state in the first hot working, at least one side surface is brought to the unconstrained state, and in the two side surfaces of the rare-earth magnet precursor, which are in the unconstrained state in the first hot working, at least one side surface, which is opposite by 180° to the side surface that is newly brought to the unconstrained state, is brought to the constrained state.

After changing the constrained/unconstrained states of the two opposite side surfaces as described above, in the second hot working, the upper and lower surfaces of the rare-earth sintered body are pressed by the upper and lower punches. In this case, the rare-earth magnet precursor is compressed in the upper-lower pressing direction, and the side surfaces are apt to be deformed due to the plastic flow in the lateral direction toward the outside of the rare-earth magnet precursor. At this time, in the rare-earth magnet precursor, the side surface, whose deformation is permitted in the first hot working, is brought to the constrained state, and thus deformation of the side surface in the lateral direction is suppressed. In addition, the side surface, whose deformation is suppressed in the first hot working, is brought to the unconstrained state, and thus deformation of the side surface in the lateral direction is permitted.

Accordingly, the frictional force, which acts on the rare-earth magnet precursor in the section, increases toward the side surface whose deformation is permitted in the first hot working, and which is in the constrained state. In addition, the frictional force decreases toward the side surface whose deformation is suppressed in the first hot working, and which is in the unconstrained state, from the side surface in the constrained state. Further, the vicinity of the side surface of the rare-earth magnet precursor, which is in the constrained state, is compressed in a state in which the plastic flow in the lateral direction is suppressed due to contact with the die. Accordingly, the vicinity of the side surface of the rare-earth magnet precursor, whose deformation is permitted in the first hot working and which is in the constrained state, is uniformly compressed in the pressing direction, and thus the strain distribution of the produced rare-earth magnet is more uniform, as compared, to the related art.

As described above, the side surface, which is brought to the constrained state in the first hot working in the two opposite side surfaces of the sintered body, is different from the side surface which is brought to the constrained state in the second hot working in the two opposite side surfaces of the rare-earth magnet precursor. Thus, a region, in which the plastic flow is most, unlikely to occur during plastic deformation of the sintered body in the first hot working, is made different from a region in which the plastic flow is most unlikely to occur during plastic deformation of the rare-earth magnet precursor in the second hot working. On the other hand, a region, in which the plastic flow is most likely to occur during plastic deformation of the sintered body in the first hot working, is made different from a region in which the plastic flow is most likely to occur during plastic deformation of the rare-earth magnet precursor in the second hot working.

Thus, the plastic flow of the sintered body and the rare-earth magnet precursor becomes more uniform through the first hot working and the second hot working, as compared to the related art, and thus the strain distribution in the section of the rare-earth magnet is more uniform, as compared to the related art. As described, since the strain of the produced rare-earth magnet is uniform, magnetic properties in the vicinity of a surface of the rare-earth magnet are improved, and the overall magnetic properties are improved. As a result, a low-magnetization portion of the rare-earth magnet decreases, and thus a yield ratio of the rare-earth magnet is also improved.

In each of the sintered body and the rare-earth magnet precursor, the side surface, which is brought to the constrained state, may be maintained in the constrained state from start to end of pressing. In this case, the region in the section of the sintered body or the rare-earth magnet precursor, in which the plastic flow is most unlikely to occur, is constant during the process of pressing. In addition, as described above, the region, in which the plastic flow is most unlikely to occur during plastic deformation of the sintered body in the first hot working, is inverted to the region in which the plastic flow is most unlikely to occur during plastic deformation of the rare-earth magnet precursor in the second hot working. Thus, a relationship between the magnitude and direction of frictional force vector in the first hot working is inverted to that in the second hot working. Accordingly, a material flow becomes more uniform through the first hot working and the second hot working, and thus the strain distribution in the first hot working and the strain distribution in the second hot working cancel each other, and thus the strain distribution of the rare-earth magnet becomes even more uniform.

In each of the sintered body and the rare-earth magnet precursor, the side surface, which is to be brought to the constrained state, may not be caused to come into contact with the inner surface of the die and may be brought to the unconstrained state at an initial stage of pressing, and may be caused to come into contact with the inner surface of the die and may be brought to the constrained state in a course of the pressing. In this case, it is possible to change the region in the section of the sintered body or the rare-earth magnet precursor, in which the plastic flow is most unlikely to occur, in the course of the pressing.

The two opposite side surfaces are in the unconstrained state at an initial stage of the pressing of each of the sintered body and the rare-earth magnet precursor, that is, until the side surface, which is to be brought to the constrained state due to plastic deformation of the sintered body or the rare-earth magnet precursor, comes into contact with the die after start of the pressing. Accordingly, at the initial stage of the pressing of each of the sintered body and the rare-earth magnet precursor, the region in which the plastic flow is most unlikely to occur is present in the central portion of each of the upper and lower surfaces and the vicinity thereof in each of the sintered body and the rare-earth magnet precursor.

When each of the sintered body and the rare-earth magnet precursor is further pressed, each of the sintered body and the rare-earth magnet precursor is further plastically deformed, and thus the side surface, which is to be brought to the constrained state, comes into contact with the die and the side surface is brought to the constrained state. In each of the sintered body and the rare-earth magnet precursor, after the side surface comes into contact with the die, the region in which the plastic flow is most unlikely to occur is present in the vicinity of the side surface that is brought to the constrained state. Thus, in each of the sintered body and the rare-earth magnet precursor, the region, in which the plastic flow is most unlikely to occur, is changed in the course of the pressing. This change also contributes to making the strain distribution of the rare-earth magnet uniform.

In each of the sintered body and the rare-earth magnet precursor, two side surfaces, which are perpendicular to the two side surfaces parallel to the pressing direction, may be maintained in the constrained state from start to end of pressing.

As can be seen from the above description, according to the method of producing a rare-earth magnet according to the above-mentioned aspect of the invention, the rare-earth magnet precursor is produced by the first hot working in which, in the two side surfaces of the sintered body, which are parallel to the pressing direction and are opposite to each other, one side surface is brought to the constrained state to suppress deformation, and the other side surface is brought to the unconstrained state to permit deformation. In addition, the rare-earth magnet is produced by the second hot working in which, in the two side surfaces of the rare-earth magnet precursor, which are parallel to the pressing direction, a side surface, which is in the unconstrained state in the first hot working, is brought to the constrained state to suppress deformation, and a side surface, which is in the constrained state in the first hot working, is brought to the unconstrained state to permit deformation. Accordingly, it is possible to make the strain distribution uniform while giving desired magnetic anisotropy to the rare-earth magnet. As a result, it is possible to produce the rare-earth magnet, which is excellent in magnetic properties in the vicinity of a surface and the overall magnetic properties, with a high yield ratio.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1A:
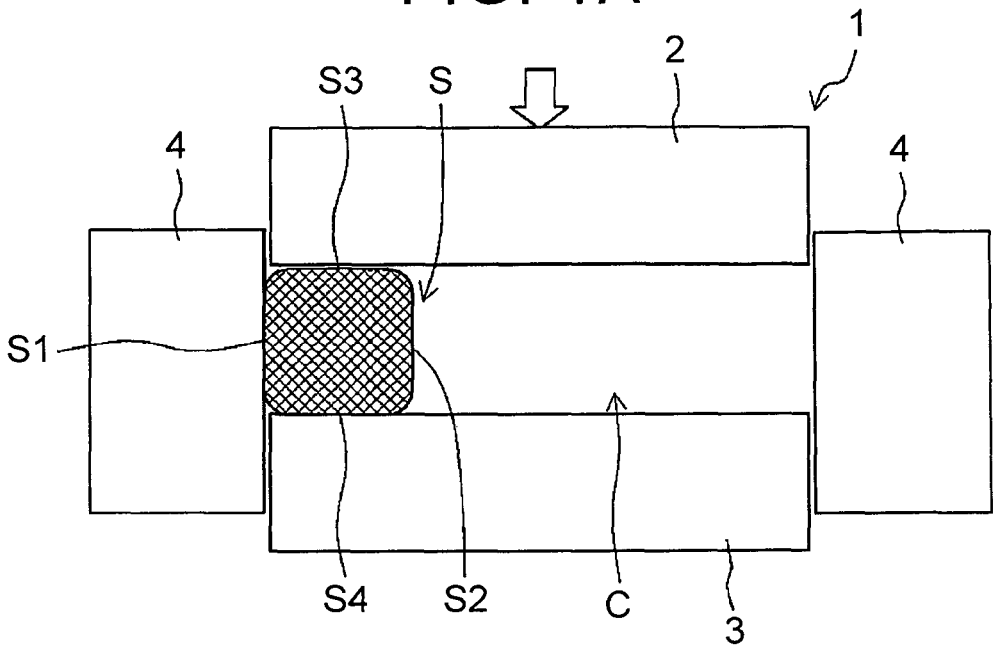
FIGS. 1A and 1B are explanatory diagrams of a first step in a method of producing a rare-earth magnet according to a first embodiment of the invention.

Hereinafter, a method of producing a rare-earth magnet according to an embodiment of the invention will be described with reference to the attached drawings. The following embodiment describes the method of producing the rare-earth magnet that is a nanocrystal magnet. However, the method of producing the rare-earth magnet according to the invention is not limited to the production of the nanocrystal magnet, and is applicable to production of a sintered magnet having a relatively large grain size (for example, a sintered magnet having a particle size of approximately 1 μm).

First Embodiment of Method of Producing Rare-Earth Magnet

In a method of producing a rare-earth magnet according to this embodiment, a sintered body, which is solidified by sintering a rare-earth magnet material such as a magnet powder produced by, for example, a liquid quenching method, is subjected to hot working to obtain a desired shape, and to give magnetic anisotropy to the sintered body.

In this embodiment, for example, the sintered body which is subjected to the hot working is produced as follows. First, an alloy ingot is high-frequency melted in a furnace (not shown) under an Ar gas atmosphere decompressed to, for example, 50 kPa or lower according to a melt spinning method using a single roll, and a molten metal having a composition for producing a rare-earth magnet is sprayed onto a copper roll to prepare a quenched thin band (a quenched ribbon), and this quenched ribbon is coarsely crushed.

Next, the quenched ribbon that is coarsely crushed is filled in a cavity defined by a cemented carbide die and a cemented carbide punch that slides in a hollow inside of the cemented carbide die, and is electrically heated by allowing a current to flow in a pressing direction while being pressed by the cemented carbide punch, thereby preparing a molded body that is constituted by a Nd—Fe—B-based main phase (grain size: approximately 50 nm to 200 nm) having a nanocrystalline structure and a grain boundary phase of a Nd—X alloy (X represents a metal element) at the periphery of the main phase.

The molded body, which is obtained, is filled in the cavity defined by the cemented carbide die and the cemented carbide punch that slides in the hollow inside of the cemented carbide die, and is electrically heated by allowing a current to flow in a pressing direction while being pressed by the cemented carbide punch, thereby preparing a sintered body that is constituted by a RE-Fe—B-based main phase having a nanocrystalline structure (RE represents at least one kind of element selected from a group consisting of Nd, Pr, and Y) (having a grain size of approximately 20 nm to 200 nm), and a grain boundary phase of a Nd—X alloy (X represents a metal element) at the periphery of the main phase through hot press processing.

The Nd—X alloy, which constitutes the grain boundary phase, is constituted by an alloy of Nd and at least one kind of element selected from a group consisting of Co, Fe, Ga, and the like. The Nd—X alloy is constituted by, for example, any one kind or two or more kinds selected from among Nd—Co, Nd—Fe, Nd—Ga, Nd—Co—Fe, and Nd—Co—Fe—Ga, and the Nd—X alloy is in an Nd-rich state.

The sintered body has an isotropic crystalline structure in which the grain boundary phase is filled between a plurality of the nanocrystal grains (main phases). Accordingly, the hot working is performed on the sintered body to provide anisotropy thereto. In this embodiment, two-stage hot working is performed, that is, first hot working is performed at a first step to be described below, and second hot working is performed at a subsequent second step.

(First Step)

Figure 1B:
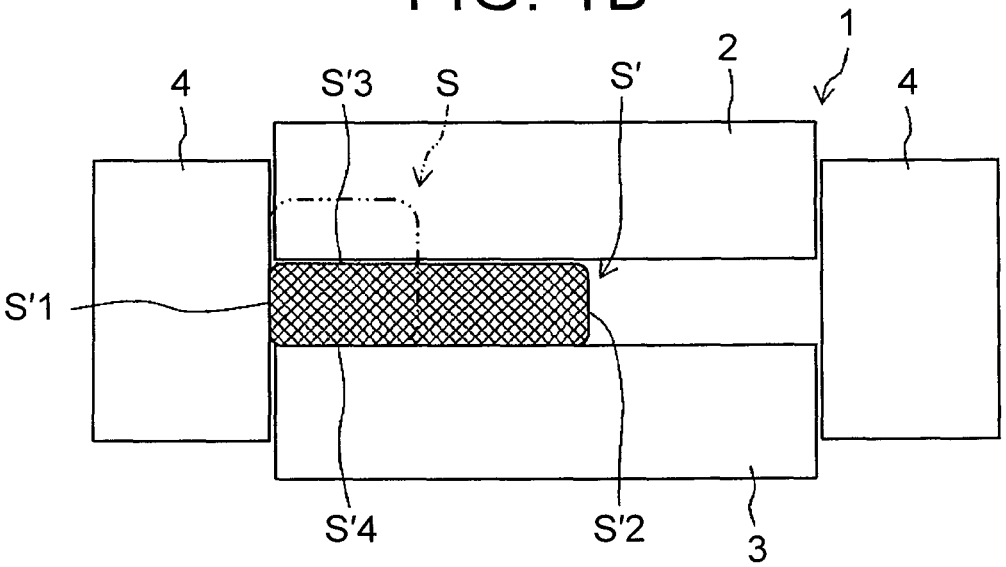
Figure 1C:
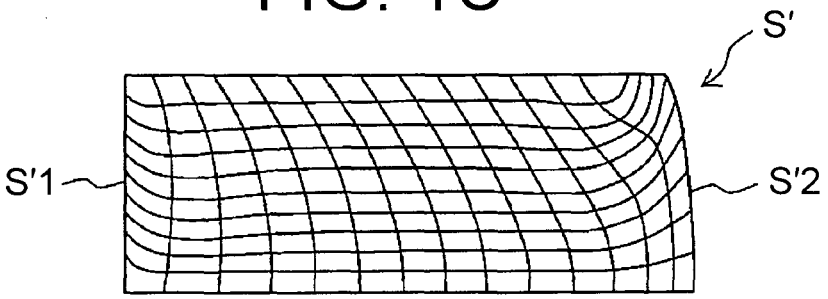
FIG. 1C is a diagram illustrating a strain distribution of a rare-earth magnet precursor after the first step is performed.

In the first step, the first hot working is performed on the sintered body to produce a rare-earth magnet precursor. FIGS. 1A and 1B are process diagrams of the first step, and are also sectional diagrams parallel to a sintered body pressing direction. FIG. 1C is a diagram illustrating a strain distribution in a section of the rare-earth magnet precursor shown in FIG. 1B. Each of FIGS. 1A to 1C illustrates a section along a central line parallel to front and rear side surfaces of the sintered body and the rare-earth magnet precursor.

As shown in FIG. 1A, in the first step, first, a sintered body S is accommodated in a cavity C of a forming mold 1. The shape of the sintered body S is a hexahedron such as a cube and a rectangular parallelepiped. The forming mold 1 is constituted by a pair of cemented carbide punches 2, 3 that is vertically disposed to face each other, and a cemented carbide die 4 that is disposed around the cemented carbide punches 2, 3. The cavity C of the forming mold 1 is a space defined by the pair of punches 2, 3 and the die 4. At least one of the pair of punches 2, 3 is configured to slide in the hollow inside of the die 4. In this embodiment, the upper punch 2 is configured to slide upward and downward in the hollow inside of the die 4 so as to press an upper surface S3 and a lower surface S4 of the sintered body S that is placed on the lower punch 3.

When accommodating the sintered body S in the cavity C of the forming mold 1, as shown in FIG. 1A, in the two side surfaces S1, S2 of the sintered body S, which are parallel to the pressing direction and are opposite to each other, one side surface S1 is caused to come into contact with an inner surface of the die 4 and is brought to a constrained state, and the other side surface S2 is not caused to come into contact with the inner surface of the die 4 and is brought to an unconstrained state. In this embodiment, front and rear side surfaces, which are perpendicular to the right and left side surfaces S2, S1 shown in FIG. 1A, are caused to come into contact with the inner surface of the die 4 and are brought to the constrained state. Thus, the left side surface S1 and the front and rear side surfaces of the sintered body S, which are brought to the constrained state, are maintained in contact with the inner surface of the die 4 and are maintained in the constrained state from start to end of the process of pressing the sintered body S.

Next, as shown in FIG. 1B, the upper punch 2 is caused to descend toward the lower punch 3, and the upper and lower punches 2, 3 press the upper and lower surfaces S3, S4 of the sintered body S to perform compression in an upper-lower pressing direction. At this time, the left side surface S1 of the sintered body S is apt to be deformed in the leftward direction toward the outside of the sintered body S, and the right side surface S2 is apt to be deformed in the rightward direction toward the outside of the sintered body due to a plastic flow. However, the plastic flow in the leftward direction is restrained in the vicinity of the left side surface S1 which is in contact with the inner surface of the die 4 and is in the constrained state. Accordingly, in the sintered body S, deformation of the left side surface S1, which is in the constrained state, in the leftward direction is suppressed, and deformation of, the right side surface S2, which is in the unconstrained state, in the rightward direction is permitted. In addition, deformation of the front and rear side surfaces, which are in the constrained state, is suppressed.

At this time, a frictional, force, which acts between the upper and lower surfaces S3, S4 of the sintered body S and the upper and lower punches 2, 3, respectively, increases toward the left side surface S1 of the sintered body S which is brought to the constrained state. In addition, the frictional force decreases in the rightward direction from the left side surface S1, that is, toward the right side surface S2 that is brought to the unconstrained state. Accordingly, the plastic flow is hindered to a larger degree by the frictional force at a location closer to the left side surface S1 in the constrained state. In addition, since the left side surface. S1 of the sintered body S is in the constrained state, the vicinity of the left side surface S1 is compressed in a state in which the plastic flow in the leftward direction is suppressed due to contact with the inner surface of the die 4. Accordingly, the vicinity of the left side surface S1 of the sintered body S, which is in the constrained state, is uniformly compressed in the pressing direction, and thus a rare-earth magnet precursor S' is produced.

As shown in FIG. 1C, a strain distribution of the rare-earth magnet precursor S', which is produced through the first step, is more uniform than a strain distribution of the rare-earth magnet of the related art described below. In FIG. 1C, in the rare-earth magnet precursor S', a strain of a right side surface S'2 brought to the unconstrained state is larger than a strain in the vicinity of a left side surface S'1 brought to the constrained state.

(Second Step)

Figure 2A:
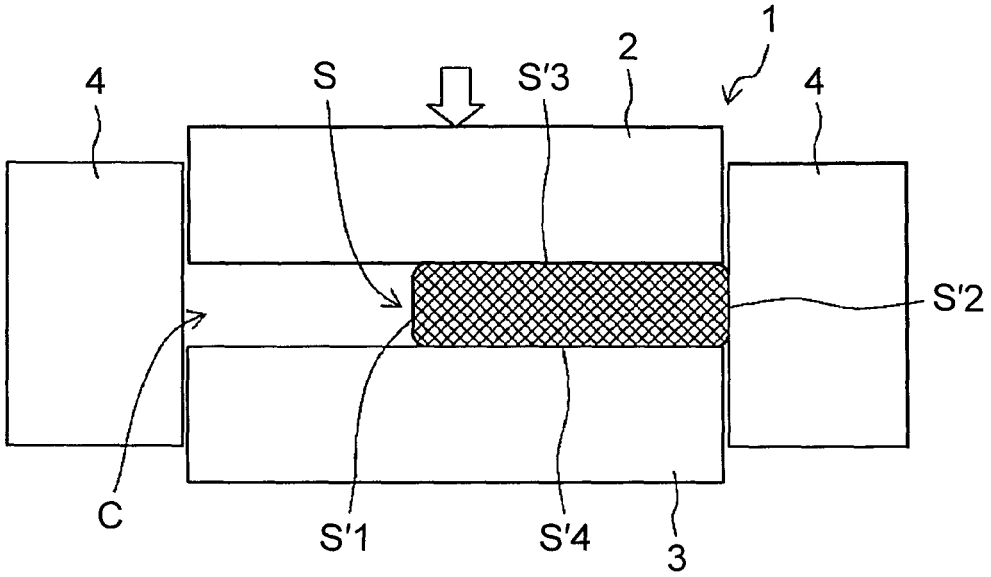
FIGS. 2A and 2B are explanatory diagrams of a second step according to the first embodiment.
Figure 2B:
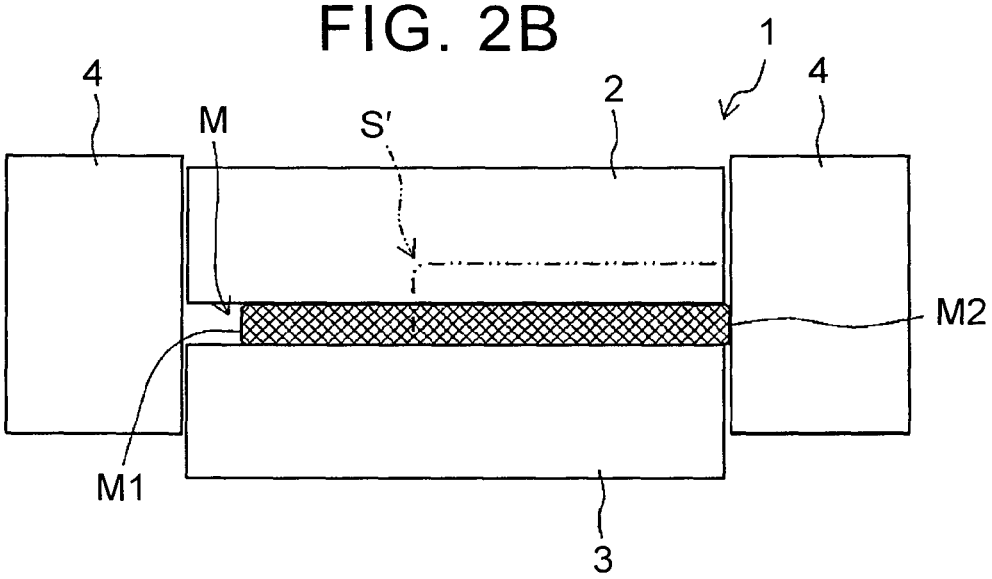
Figure 2C:
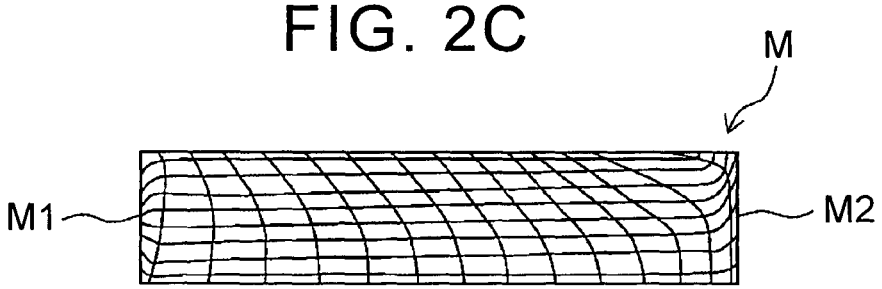
FIG. 2C is a diagram illustrating a strain distribution of a rare-earth magnet after the second step is performed.

In a second step, second hot working is performed on the rare-earth magnet precursor S' that is produced in the first step, thereby producing a rare-earth magnet. FIGS. 2A and 2B are process diagrams of the second step, and are also sectional diagrams parallel to a rare-earth magnet pressing direction. FIG. 2C is a diagram illustrating a strain distribution in a section of the rare-earth magnet shown in FIG. 2B. As is the case with FIGS. 1A to 1C, each of FIGS. 2A to 2C illustrates a section along a central line parallel to front and rear side surfaces of the rare-earth magnet precursor S' and the rare-earth magnet.

As shown in FIG. 2A, in the second step, first, the rare-earth magnet precursor. S' is moved in the cavity C of the forming mold 1. At this time; the left side surface S'1, which is brought to the constrained state during the pressing in the first step, is not caused to come into contact with the inner surface of the die 4 and is brought to an unconstrained state, and the right side surface S'2, which is brought to the unconstrained state during the pressing in the first step, is caused to come into contact with the inner surface of the die 4 and is brought to the constrained state. The front and rear side surfaces perpendicular to the right and left side surfaces S'2, S'1 in FIG. 2A are caused to come into contact with the inner surface of the die 4 and are brought to the constrained state as in the first step. In this embodiment, the same forming mold 1 as that used in the first step is used in the second step, but a forming mold different from that used in the first step may be used in the second step.

Next, as shown in FIG. 2B, the upper punch 2 is caused to descend toward the lower punch 3, and the upper and lower punches 2, 3 press upper and lower surfaces S'3, S'4 of the rare-earth magnet precursor S' to perform compression in the upper-lower pressing direction. At this state, the left side surface S'1 of the rare-earth magnet precursor S' is apt to be deformed in the leftward direction toward the outside of the sintered body S due to the plastic flow, and the right side surface S'2 is apt to be deformed in the rightward direction toward the outside of the sintered body S. However, the plastic flow in the rightward direction is restrained in the vicinity of the right side surface S'2 which is in contact with the inner surface of the die 4 and is in the constrained state. Accordingly, in the rare-earth magnet precursor S', deformation of the right side surface S'2, which is in the constrained state, in the rightward direction is suppressed, and deformation of the left side surface S'1, which is in the unconstrained state, in the leftward direction is permitted. In addition, deformation of the front and rear side surfaces, which are in the constrained state, is suppressed.

As described above, the right side surface S'2, which is brought to the unconstrained state in the first step and in which the deformation is permitted in the first step, is brought to the constrained state and deformation is suppressed in the second step. Similarly, the left side surface S'1, which is brought to the constrained state in the first step and in which the deformation is suppressed in the first step, is brought to the unconstrained state and deformation is permitted in the second step.

Accordingly, a frictional force, which acts on the upper and lower surfaces S'3, S'4 of the rare-earth magnet precursor S' in the second step, increases toward the right side surface S'2 that is in the constrained state conversely to the first step. The frictional force decreases in the leftward direction from the right side surface S'2, that is, toward the left side surface S'1 that is in the unconstrained state. Accordingly, the plastic flow is hindered to a larger degree due to the frictional force at a location closer to the right side surface S'2 in the constrained state. In addition, since the right side surface S'2 of the rare-earth magnet precursor S' is brought to the constrained state, the vicinity of the right side surface S'2 is compressed in a state in which the plastic flow in the rightward direction is suppressed. Thus, the vicinity of the right side surface S'2 of the rare-earth magnet precursor S' is uniformly compressed in the pressing direction, and thus a rare-earth magnet M is produced.

As described above, in the method of producing the rare-earth magnet of this embodiment, the first hot working is performed in the first step, and the second hot working is performed in the second step. Accordingly, the strain distribution of the rare-earth magnet M becomes uniform by the two-stage hot working in which the second hot working is performed in the second step. That is, the side surfaces of the sintered body S, Which are brought to the constrained state in the first hot working, are different from the side surfaces of the rare-earth magnet precursor S', which are brought to the constrained state in the second hot working.

Thus, a region, in which the plastic flow is most unlikely to occur during the plastic deformation of the sintered body S or the rare-earth magnet precursor S', can be changed from one end to the other end, that is, from, the vicinity of the left side surface S1 to the vicinity of the right side surface S'2. On the other hand, a region, in which the plastic flow is most likely to occur during the plastic deformation of the sintered body S or the rare-earth magnet precursor S', can be changed from the vicinity of the right side surface S2 to the vicinity of the left side surface S'1. In addition, the rare-earth magnet M is produced by compressing the sintered body S and the rare-earth magnet precursor S' in the pressing direction in a state in which the deformation of the side surface S1 of the sintered body S or the side surface S'2 of the rare-earth magnet precursor S' in a lateral direction is suppressed at least one time due to contact with the die 4.

Figure 9A:
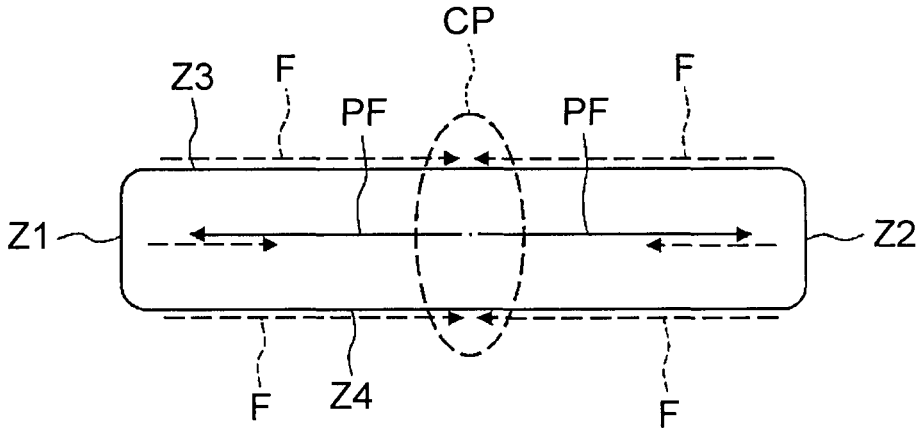
FIG. 9A RELATED ART
FIG. 9A is an explanatory diagram of a relationship between a frictional force and a plastic flow at a section CS shown in FIG. 8B.
Figure 9B:
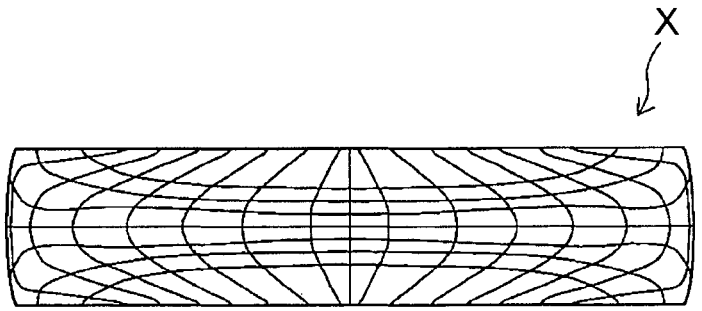
FIG. 9B RELATED ART
FIG. 9B is a diagram illustrating a strain distribution at the same section of the rare-earth magnet in the related art.

Accordingly, a material flow becomes more uniform through the first step and the second step as compared to the related art. As a result, as shown in FIG. 2C, the strain distribution in the section of the produced rare-earth magnet M is more uniform than the strain distribution in the section of the rare-earth magnet X in the related art shown in FIG. 9B. As described above, since the strain distribution in the section of the rare-earth magnet M is more uniform as compared to the related art, magnetic properties in the vicinity of a, surface of the rare-earth magnet M are improved, and the overall magnetic properties are improved. As a result, a low-magnetization portion of the rare-earth magnet M decreases, and thus a yield ratio of the rare-earth magnet M is also improved.

The side surface S1 of the sintered body S, which is brought to the constrained state, and the side surface S'2 of the rare-earth magnet precursor S', which is brought to the constrained state, are maintained in contact with the inner surface of the die 4 from start to end of pressing, and thus are maintained in the constrained state. Accordingly, in the first hot working, the region of the sintered body S, in which the plastic flow is most unlikely to occur, is constant without being changed in the course of the pressing. Then, a region in which the plastic flow is less likely to occur is changed due to movement of the rare-earth magnet precursor S'. In the second hot working, a region of the rare-earth magnet precursor S', in which the plastic flow is most unlikely to occur, is constant without being changed from start to end of pressing.

Thus, a relationship between the magnitude and direction of frictional force vector in the first hot working is inverted by 180° to that in the second hot working. Accordingly, the region of the sintered body S, in which the plastic flow is most unlikely to occur, is inverted to the region of the rare-earth magnet precursor S' in which the plastic flow is most unlikely to occur, and thus a material flow becomes more uniform through the entirety of the process. Accordingly, the strain distribution in the first hot working and the strain distribution in the second hot working cancel each other, and thus the strain distribution in the same section of the rare-earth magnet M becomes even more uniform.

As described above, according to the method of producing the rare-earth magnet relating to the first embodiment, hot working is performed in multiple stages, and a portion in which a force hindering the plastic flow of the material becomes maximum is changed each time the stage is changed. Accordingly, it is possible to improve the residual magnetization of the rare-earth magnet M by making the strain distribution of the produced rare-earth magnet M uniform while giving desired magnetic anisotropy to the sintered body S during the hot working. As a result, it is possible to produce the rare-earth magnet M, which is excellent in magnetic properties in the vicinity of a surface and the overall magnetic properties, with a high yield ratio.

Second Embodiment of Method of Producing Rare-Earth Magnet

Hereinafter, a method of producing the rare-earth magnet according to a second embodiment of the invention will be described with reference to the attached drawings. The method of producing the rare-earth magnet according to this embodiment is different from the first embodiment in that side surfaces of the sintered body and the rare-earth magnet precursor, which are to be brought to the constrained state, are not caused to come into contact with the inner surface of the die and are brought to the unconstrained state at an initial stage of the pressing, and are caused to come into contact with the inner surface of the die and are brought to the constrained state in the course of the pressing. The other configurations are the same as the first embodiment, and the same reference numerals are given to the same configurations and a description thereof will not be repeated.

Figure 3A:
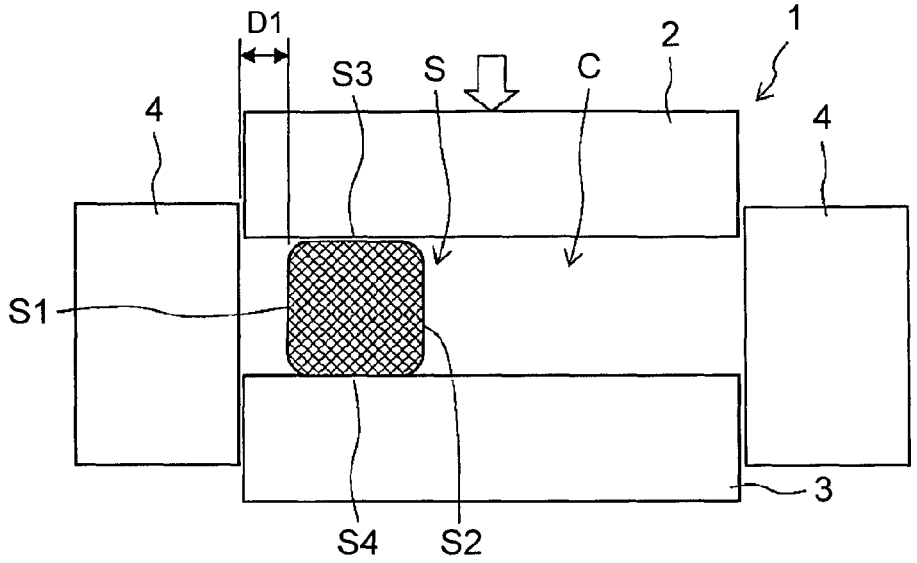
FIGS. 3A to 3C are explanatory diagrams of a first step in a method of producing a rare-earth magnet according to a second embodiment of the invention.
Figure 3B:
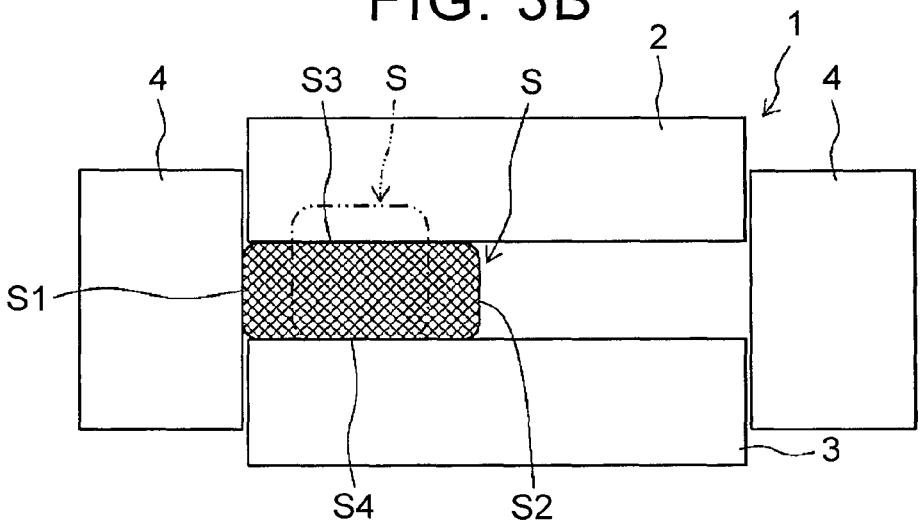
Figure 3C:
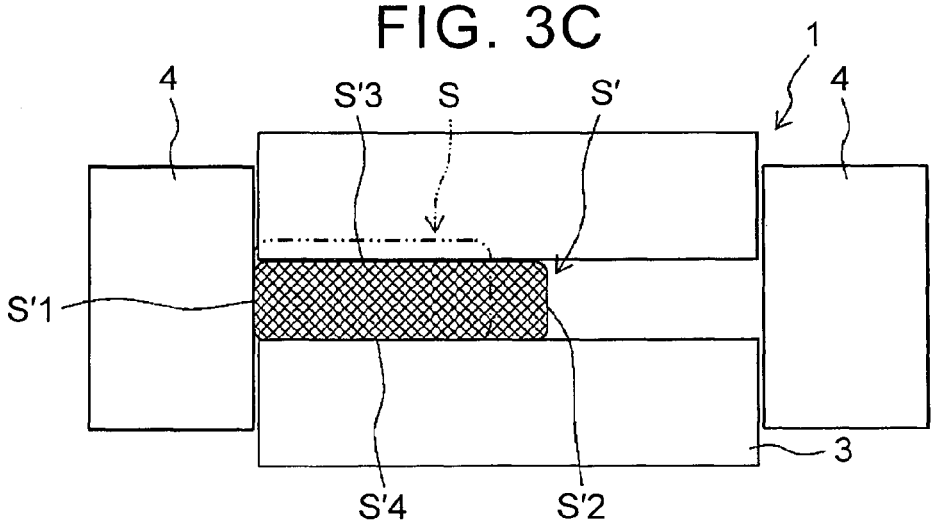

FIGS. 3A to 3C are process diagrams of a first step of this embodiment, and are also sectional diagrams parallel to a sintered body pressing direction. Each of FIGS. 3A to 3C illustrates a section along a central line parallel to front and rear side surfaces of a sintered body and a rare-earth magnet precursor.

(First Step)

As shown in FIG. 3A, in a first step, first, the sintered body S is accommodated in the cavity C of the forming mold 1. At this time, the sintered body S is disposed with a predetermined distance D1 between the left side surface S1 of the sintered body S and the inner surface of the die 4 so that the left side surface S1 of the sintered body S, which is to be brought to the constrained state, is deformed in the leftward direction and comes into contact with the inner surface of the die 4 in the course of the pressing. That is, the left side surface S1 of the sintered body S is not caused to come into contact with the inner surface of the die 4, and is brought to the unconstrained state at an initial stage of the pressing of the sintered body S. As is the case with the first embodiment, the right side surface S2 of the sintered body S is maintained in the unconstrained state from start to end of pressing in the first step. As is the case with the first embodiment, the front and rear side surfaces are also maintained in the constrained state from start to end of pressing in the first step.

For example, the distance D1 between the left side surface S1 of the sintered body S and the inner surface of the die 4 is set to be less than a half of a deformation amount in the first step in a direction in which the right and left side surfaces S2, S1 of the sintered body S are opposite to each other. In other words, the distance D1 is set to be equal to or less than a half of a difference between a distance between the right and left side surfaces S'2, S'1 of a rare-earth magnet precursor S' that is produced by the first hot working in the first step and a distance between the right and left side surfaces S2, S1 of the sintered body S before the first hot working.

Next, as shown in FIG. 3B, the upper punch 2 is caused to descend toward the lower punch 3, and the upper and lower punches 2, 3 press the upper and lower surfaces S3, S4 of the sintered body S to perform compression in an upper-lower pressing direction. In this case, the left side surface S1 of the sintered body S is deformed in the leftward direction toward the outside of the sintered body S due to a plastic flow, and the right side surface S2 is deformed in the rightward direction toward the outside of the sintered body S. At this time, the left side surface S1, which is in the unconstrained state, is deformed toward the leftward direction, and is caused to come into contact with the inner surface of the die 4 and is brought to the constrained state in the course of the pressing.

As described above, the right and left side surface S2, S1 of the sintered body S are in the unconstrained state until the left side surface S1 comes into contact with the inner surface of the die 4 due to deformation of the left side surface S1 after start of pressing of the sintered body S. Accordingly, as shown in FIG. 3B, the left side surface S1 of the sintered body S is deformed in the leftward direction, and the right side surface S2 is deformed in the rightward direction.

At this time, the frictional force that acts on the upper surface S3 and the lower surface S4 of the sintered body S is largest at the central portions of the upper and lower surfaces S3, S4 of the sintered body S in the right-left direction, and decreases toward the two side surfaces S1, S2 of the sintered body S which are opposite to each other. Accordingly, the plastic flow is most unlikely to occur at the central portions of the upper and lower surfaces S3, S4 of the sintered body S until the left side surface S1 is brought to the constrained state after start of pressing of the sintered body S.

When the upper and lower surfaces S3, S4 of the sintered body S are further pressed by the upper and lower punches 2, 3, after the left side surface S1 is caused to come into contact with the inner surface of the die 4 and is brought to the constrained state in the course of the pressing of the sintered body S, deformation of the left side surface S1 of the sintered body S, which is in the constrained state, in the leftward direction is suppressed, and deformation of the right side surface S2, which is in the unconstrained state, in the rightward direction is permitted and compression in the pressing direction is performed as shown in FIG. 3C, as is the case with the first step of the first embodiment. In addition, deformation of the front and rear side surfaces, which are in the constrained state, is suppressed.

At this time, as is the case with the first embodiment, the frictional force, which acts on the upper surface S3 and the lower surface S4 of the sintered body, increases toward the left side surface S1 of the sintered body S which is in the constrained state. The frictional force decreases toward the right side surfaces S2 that is in the unconstrained state. Accordingly, after the left side surface S1 is brought to the constrained state in the course of the pressing of the sintered body S, the plastic flow is most unlikely to occur in the vicinity of the left side surface S1 in the constrained state.

That is, in this embodiment, it is possible to change the region of the sintered body S in which the plastic flow is most unlikely to occur, in the course of the pressing of the sintered body S in the first hot working in the first step. Thus, as is the case with the first embodiment, the strain distribution of the rare-earth magnet precursor S' that is produced through the first step is more uniform than the strain distribution of the rare-earth magnet X in the related art.

(Second Step)

Figure 4A:
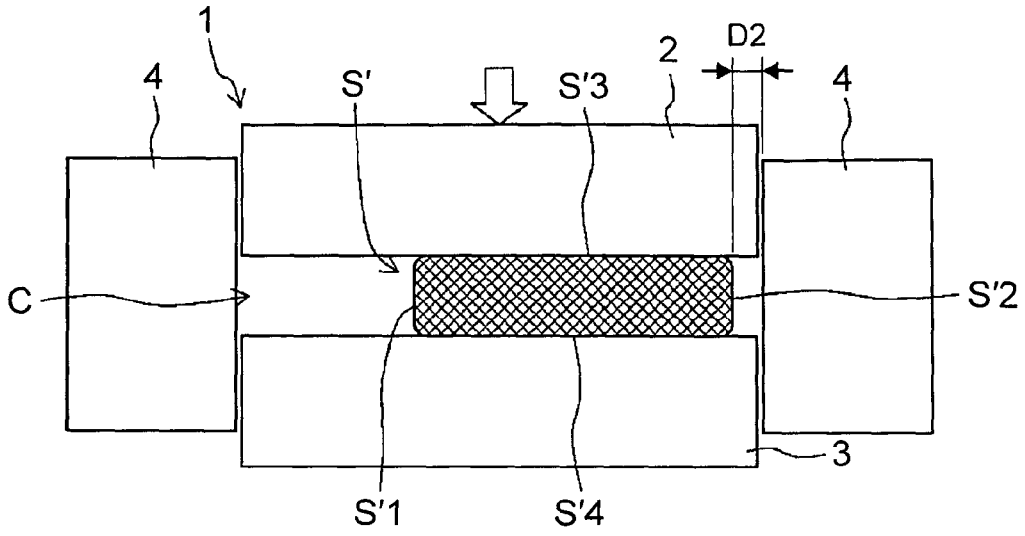
FIGS. 4A to 4C are explanatory diagrams of a second step according to the second embodiment.
Figure 4B:
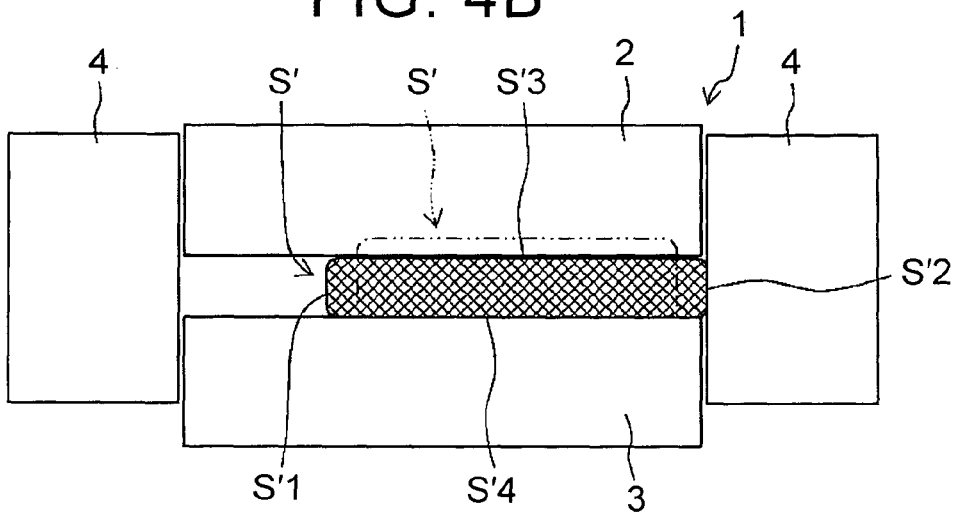
Figure 4C:
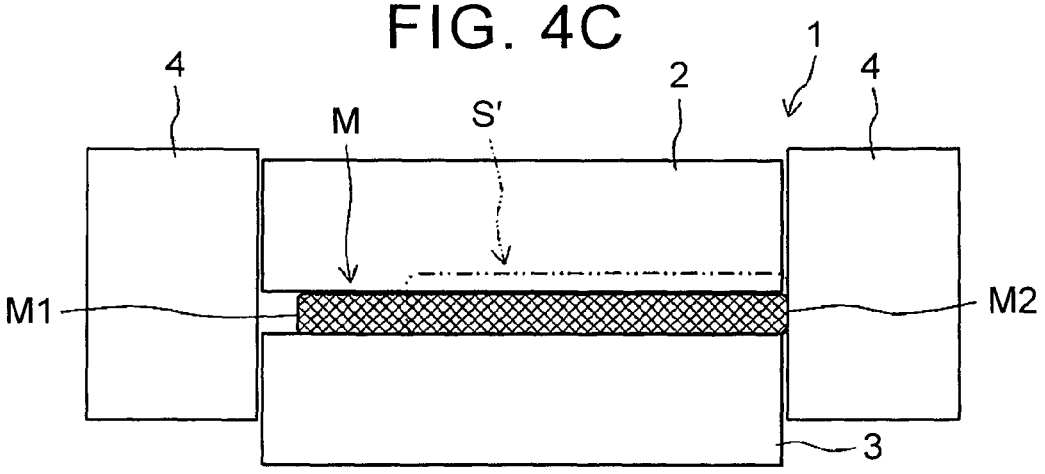

In a second step, second hot working is performed on the rare-earth magnet precursor S' that is produced in the first step, thereby producing a rare-earth magnet M. FIGS. 4A to 4C are process diagrams of the second step, and are also sectional diagrams parallel to the pressing direction of the rare-earth magnet precursor S'. As is the case with FIGS. 3A to 3C, each of FIGS. 4A to 4C illustrates a section along a central line parallel to front and rear side surfaces of the rare-earth magnet precursor S' and the rare-earth magnet M.

As shown in FIG. 4A, in the second step, first, the 'rare-earth magnet precursor S' is moved in the cavity C of the forming mold 1. At this time, the rare-earth magnet precursor S' is disposed with a predetermined distance D2 between the right side surface S'2 of the rare-earth magnet precursor S' and the inner surface of the die 4 so that the right side surface S'2 of the rare-earth magnet precursor S', which is to be brought to the constrained state, is deformed in the rightward direction and comes into contact with the inner surface of the die 4 in the course of the pressing. That is, the right side surface S'2 of the rare-earth magnet precursor S' is not caused to come into contact with the inner surface of the die 4, and is brought to the unconstrained state at an initial stage of the pressing of the rare-earth magnet precursor S'. As is the case with the first embodiment, the left side surface S'1 of the rare-earth magnet precursor S' is maintained in the unconstrained state from start to end of pressing in the second step. As is the case with the first embodiment, the front and rear side surfaces are also maintained in the constrained state from start to end of pressing in the second step.

For example, the distance D2 between the right side surface S'2 of the rare-earth magnet precursor S' and the inner surface of the die 4 is set to be less than a half of a deformation amount in the second step in a direction in which the right and left side surfaces S'2, S'1 of the rare-earth magnet precursor S' are opposite to each other. In other words, the distance D2 is set to be less than a half of a difference between a distance between the right and left side surfaces M2, M2 of the rare-earth magnet M that is produced by the second hot working in the second step and a distance between the right and left side surfaces S'2, S'1 of the rare-earth magnet precursor S' before the second hot working.

Next, as shown in FIG. 4B, the upper punch 2 is caused to descent toward the lower punch 3, and the upper and lower punches 2, 3 press the upper and lower surfaces S'3, S'4 of the rare-earth magnet precursor S' to perform compression in an upper-lower pressing direction. In this case, the right side surface S'2 of the rare-earth magnet precursor S' is deformed in the rightward direction toward the outside of the rare-earth magnet precursor S' due to a plastic flow, and the left side surface S'1 is deformed in the leftward direction toward the outside of the rare-earth magnet precursor S'. At this time, the right side surface S'2, which is in the unconstrained state, is deformed in the rightward direction, and is caused to come into contact with the inner surface of the die 4 and is brought to the constrained state in the course of the pressing.

As described above, the right and left side surfaces S'2, S'1 of the rare-earth magnet precursor S' are in the unconstrained state until the right side surface S'2 comes into contact with the inner surface of the die 4 due to deformation of the right side surface S'2 after start of pressing of the rare-earth magnet precursor S'. Accordingly, as shown in FIG. 4B, the left side surface S'1 of the rare-earth magnet precursor S' is deformed in the leftward direction, and the right side surface S'2 is deformed in the rightward direction. Accordingly, as is the case with the sintered body S in the first step, the plastic flow is most unlikely to occur at the central portions of the upper and lower surfaces S'3, S'4 due to an effect of the frictional force which acts on the upper and lower surfaces S'3, S'4 of the rare-earth magnet precursor S' until the right side surface S'2 is brought to the constrained state after start of pressing of the rare-earth magnet precursor S'.

When the upper and lower surfaces S'3, S'4 of the rare-earth magnet precursor S' are further pressed by the upper and lower punches 2, 3 after the right side surface S'2 is caused to come into contact with the inner surface of the die 4 and is brought to the constrained state in the course of the pressing of the rare-earth magnet precursor S', deformation of the right side surface S'2 of the rare-earth magnet precursor S', which is in the constrained state, in the rightward direction is suppressed, and deformation of the left side surface S'1, which is in the unconstrained state, in the leftward direction is permitted and compression in the pressing direction is performed as shown in FIG. 4C, as is the case with the second step of the first embodiment. Deformation of the front and rear side surfaces, which are in the constrained state, is suppressed.

At this time, as is the case with the first embodiment, the frictional force, which acts on the upper surface S'3 and the lower surfaces S'4 of the rare-earth magnet precursor S', increases toward the right side surface S'2 of the rare-earth magnet precursor S' which is in the constrained state. The frictional force decreases toward the left side surface S'1 that is in the unconstrained state. Accordingly, as is the case with the sintered body S in the first step, after the right side surface S'2 is brought to the constrained state in the course of the pressing of the rare-earth magnet precursor S', the plastic flow is most unlikely to occur in the vicinity of the right side surface S'2 in the constrained state.

That is, in this embodiment, as is the case with the first embodiment, it is possible to change the region in which the plastic flow is most unlikely to occur during plastic deformation of the sintered body S or the rare-earth magnet precursor S' when the first step proceeds to the second step (in other words, the region in which the plastic flow is most unlikely to occur during plastic deformation of the sintered body S in the first step is different from the region in which the plastic flow is most unlikely to occur during plastic deformation of the rare-earth magnet precursor S' in the second step). Further, it is possible to change the region in which the plastic flow is most unlikely to occur, in the course of the pressing in the first step and in the course of the pressing in the second step. Thus, as is the case with the first embodiment, a material flow becomes more uniform through the first step and the second step, as compared to the related art.

Accordingly, as is the case with the first embodiment, the strain distribution in the section of the produced rare-earth magnet M is more uniform than the strain distribution in the section of the rare-earth magnet X in the related art. Thus, since the strain distribution in the section of the rare-earth magnet M is more uniform as compared to the related art, magnetic properties in the vicinity of a surface of the rare-earth magnet M are improved, and the overall magnetic properties are improved. As a result, a low-magnetization portion of the rare-earth magnet M decreases, and thus the yield ratio of the rare-earth magnet M is also improved.

As described above, according to the method of producing the rare-earth magnet according to the second embodiment, hot working is performed in multiple stages, and the portion in which the force hindering the plastic flow of the material becomes maximum is changed each time the stage is changed. Accordingly, it is possible to improve the residual magnetization of the rare-earth magnet M by making the strain distribution of the produced rare-earth magnet M uniform while giving desired magnetic anisotropy to the sintered body S during the hot working. As a result, it is possible to produce the rare-earth magnet M, which is excellent in magnetic properties in the vicinity of a surface and the overall magnetic properties, with a high yield ratio.

Example and Comparative Example

Next, magnetic properties of a rare-earth magnet of Example, which was produced by the method of producing the rare-earth magnet according to the above-described first embodiment, were compared to magnetic properties of a rare-earth magnet of Comparative Example which was produced by a method in the related art.

An alloy composition of the sintered body, which was used to produce the rare-earth magnet; was prepared by using raw materials mixed in proportions corresponding to, in terms of % by mass, Nd:14.6%, Fe:74.2%, Co:4.5%, Ga:0.5%, and B:6.2%. The shape of the sintered body was a rectangular parallelepiped. Dimensions of the sintered body were 15 mm (W)×14 mm (L)×20 mm (H) in which the width of the side surfaces S1, S2 shown in FIG. 1A in a depth direction was, set to W, the length in the right-left direction was set to L, and the height in the pressing direction was set to H. The dimensions of the rare-earth magnets of Example and Comparative Example after performing strong working on the sintered body were 15 mm (W)×70 mm (L)×4 mm (H). A case where a degree of working (reduction rate) due to the hot working is large, for example, a case where the reduction rate is approximately 10% or more may be called strong working.

With regard to working conditions of the hot working, in Example and Comparative Example, a strain rate was set to 1.0/sec, a frictional coefficient was set to 0.2, a reduction rate in the first hot working was set to 60%, and a reduction rate in the second hot working was set to 80%.

When the rare-earth magnet of Example was produced, in the first hot working, in two side surfaces of the sintered body, which were opposite to each other in a longitudinal direction (L direction), one side surface was caused to come into contact with the inner surface of the die and was brought to the constrained state to suppress deformation, and the other side surface was not caused to come into contact with the inner surface of the die and was brought to the unconstrained state to permit deformation. In the second hot working, in two side surfaces of a rare-earth magnet precursor, which were opposite to each other in the L direction, a side surface, which was in the unconstrained state in the first hot working, was caused to come into contact with the inner surface of the die and was brought to the constrained state to suppress deformation, and a side surface, which was in the constrained state in the first hot working, was brought to the unconstrained state to permit deformation. In each of the sintered body and the rare-earth magnet precursor, the two side surfaces, which were opposite to each other in a width direction (W direction), were caused to come into contact with the inner surface of the die and were brought to the constrained state in the first composition processing and the second composition processing.

When a rare-earth magnet of Comparative Example was produced, in the first hot working, two side surfaces of the sintered body, which were opposite to each other in the L direction, were not caused to come into contact with the inner surface of the die and were brought to the unconstrained state to permit deformation. Similarly, in the second hot working, the two side surfaces of the rare-earth magnet precursor, which were opposite to each other in the L direction, were not caused to come into contact with the inner surface of the die and were brought to the unconstrained state to permit deformation. The two side surfaces of each of the sintered body and the rare-earth magnet precursor were caused to come into contact with the inner surface of the die in the first composition processing and the second composition processing and were brought to the constrained state, the two side surfaces being opposite to each other in the W direction.

Next, the produced rare-earth magnets of Example and Comparative Example were subjected to cutting and the like to measure magnetic properties in the pressing direction, that is, in the thickness direction (H direction) at the W-direction and L-direction center, magnetic properties in the L direction at the W-direction center of an upper surface, and magnetic properties in the L direction at the W-directional and H-directional center.

Figure 5:
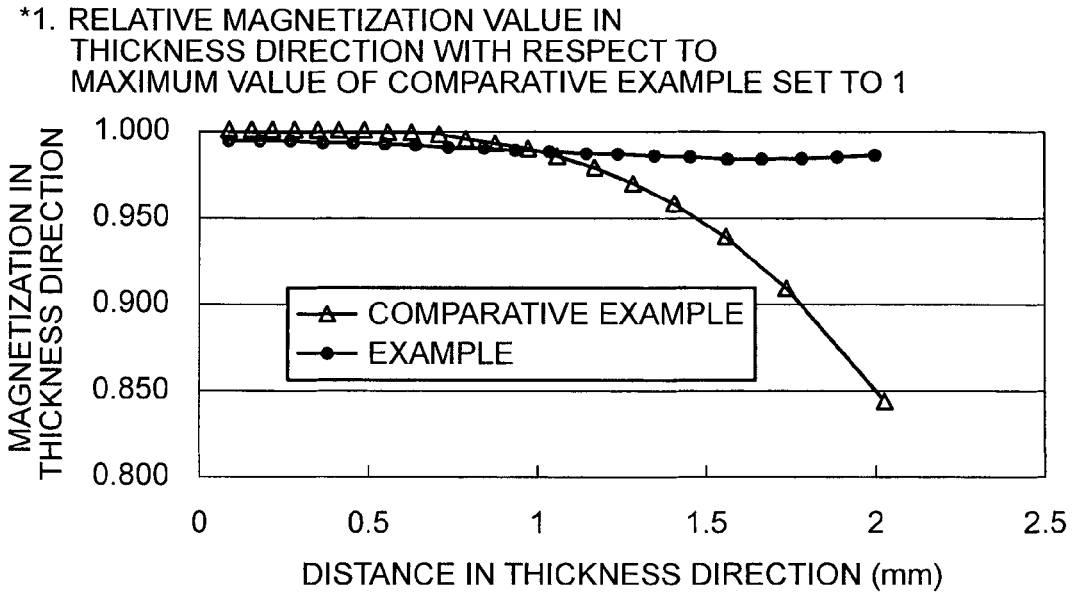
FIG. 5 is a graph illustrating residual magnetization in a thickness direction at a width-direction and longitudinal-direction center of each of rare-earth magnets of Example and Comparative Example.

FIG. 5 is a graph illustrating magnetic properties in the thickness direction at the W-direction and L-direction center in each of the rare-earth magnets of Example and Comparative Example. In the graph, the horizontal axis shows a distance (mm) from the surface of each of the rare-earth magnets in the thickness direction, and the vertical axis shows residual magnetization (T) in the thickness direction using a relative value with respect to the maximum value of Comparative Example, which is set to 1. In the drawing, a black circle represents a measurement result of the rare-earth magnet in Example, and a white triangle represents a measurement result of the rare-earth magnet of Comparative Example.

As shown in FIG. 5, in the rare-earth magnet of Comparative Example, as the distance in the thickness direction increases, the residual magnetization sharply decreases. In contrast, in the rare-earth magnet of Example, the residual magnetization is constant, regardless of the distance in the thickness direction. That is, in the rare-earth magnet of Example, a residual magnetization distribution in the thickness direction is more uniform as compared to the rare-earth magnet of Comparative Example.

Figure 6:
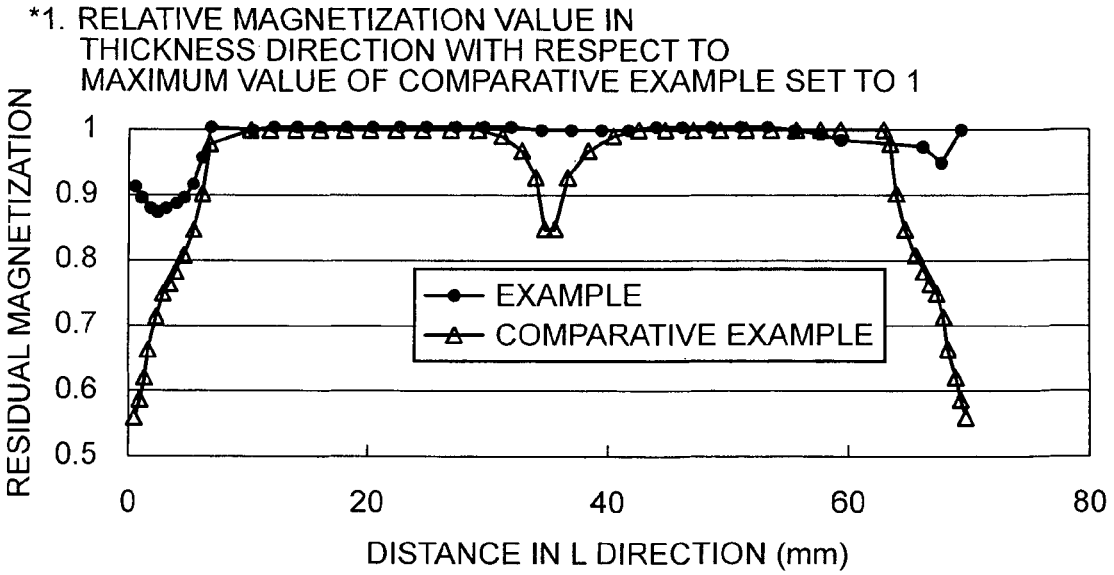
FIG. 6 is a graph illustrating residual magnetization in a longitudinal direction at a width-direction center of an upper surface of each of the rare-earth magnets of Example and Comparative Example.

FIG. 6 is a graph illustrating magnetic properties in the L direction at the W-direction center of the upper surface of each of the rare-earth magnets of Example and Comparative Example. In the graph, the horizontal axis shows a distance (mm) from one side surface of each of the rare-earth magnets in the L direction, and the vertical axis shows residual magnetization (T) of the upper surface of each of the rare-earth magnets using a relative value with respect to the maximum value of Comparative Example, which is set to 1. In the drawing, a black circle represents a measurement result of the rare-earth magnet in Example, and a white triangle represents a measurement result of the rare-earth magnet of Comparative Example.

As shown in FIG. 6, in the rare-earth magnet of Comparative Example, it is observed that the residual magnetization sharply decreases at both L-direction ends, and the residual magnetization also decreases at the L-direction central portion. In contrast, in the rare-earth magnet of Example, the decrease in the residual magnetization at the both L-direction ends is suppressed, and the decrease in the residual magnetization at the L-direction central portion is also prevented. That is, in the rare-earth magnet of Example, the residual magnetization in the vicinity of the surface is improved.

Figure 7:
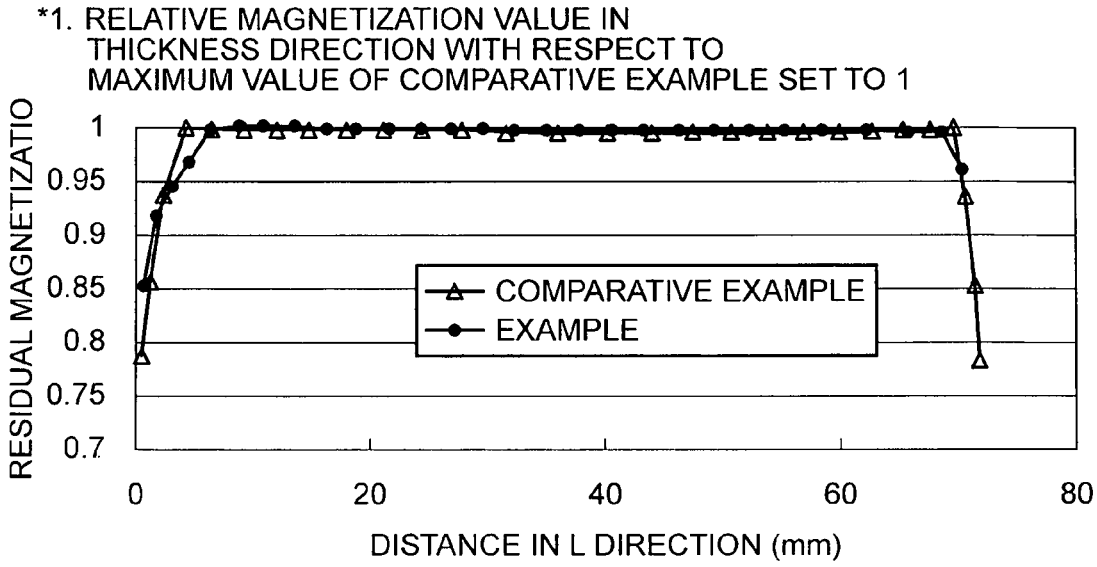
FIG. 7 is a graph illustrating residual magnetization in a longitudinal direction at a width-direction and thickness-direction center of each of the rare-earth magnets of Example and Comparative Example.
Figure 8A:
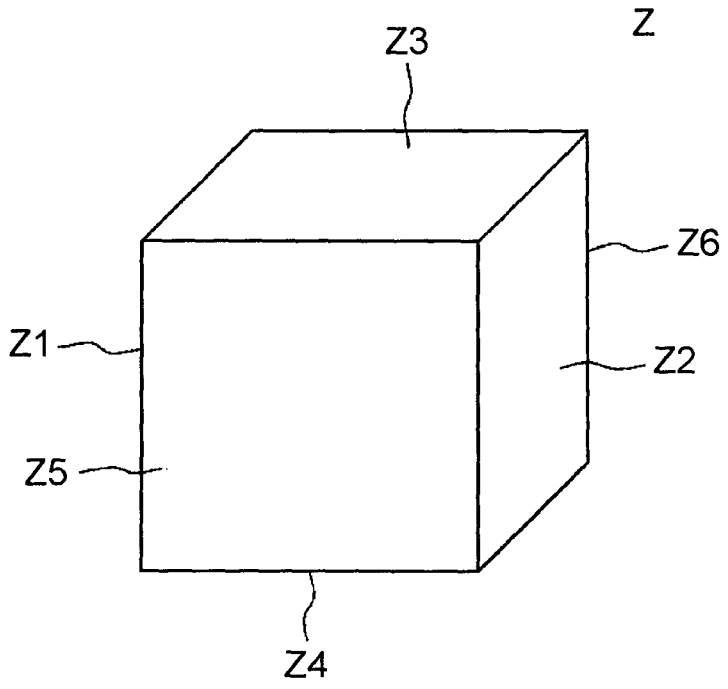
FIG. 8A RELATED ART
FIG. 8A is a perspective diagram illustrating a sintered body before working in related art.
Figure 8B:
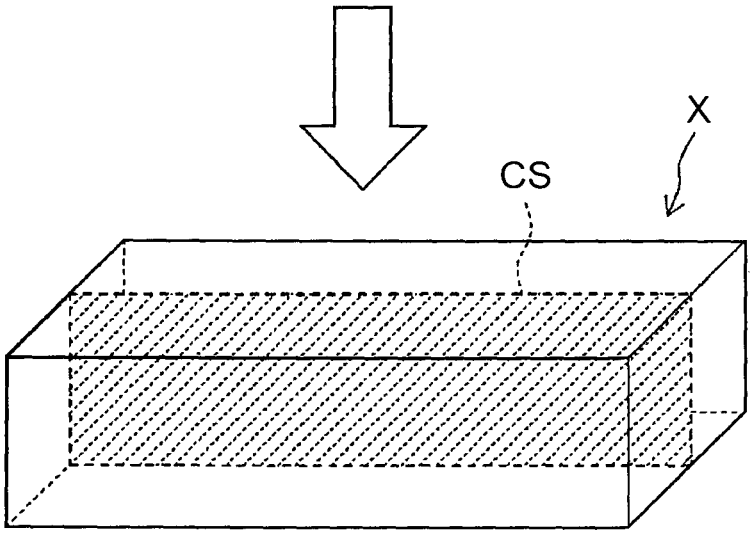
FIG. 8B RELATED ART
FIG. 8B is a perspective diagram illustrating a rare-earth magnet after the working in related art.

FIG. 7 is a graph illustrating the magnetic properties in the L direction at the W-direction and H-direction center of each of the rare-earth magnets of Example and Comparative Example. In the graph, the horizontal axis shows a distance (mm) from one side surface of each of the rare-earth magnets in the L direction, and the vertical axis shows the residual magnetization (T) at the W-direction and H-direction center using a relative value with respect to the maximum value of Comparative Example, which is set to 1. In the drawing, a black circle represents a measurement result of the rare-earth magnet in Example, and a white triangle represents a measurement result of the rare-earth magnet of Comparative Example.

As shown in FIG. 7, there is no great difference in the residual magnetization between the rare-earth magnets of Example and Comparative Example at the L-direction central portion, but the decrease in the residual magnetization of the rare-earth magnet of Example at the both L-direction ends was less in comparison to the rare-earth magnet of Comparative Example.

From the above-described measurement results, it has been confirmed that the residual magnetization of the rare-earth magnet of Example in the thickness direction is more uniform, the residual magnetization in the vicinity of the surface is improved, and the overall magnetic properties of the rare-earth magnet are improved, as compared to the rare-earth magnet of Comparative Example. From the results, with regard to a yield ratio calculated in a magnetic property range of 1.4 T or more, the yield ratio of the rare-earth magnet of Comparative Example was 86%, and the yield ratio of the rare-earth magnet of Example was 91%. Accordingly, it has been confirmed that the yield ratio of the rare-earth magnet of Example is improved, as compared to the yield ratio of the rare-earth magnet of Comparative Example.

The embodiments of the invention have been described in detail with reference to the attached drawings. However, specific configurations are not limited to the embodiments, and design modifications in a range that does not depart from the scope of the invention are included in the invention.

For example, the shape of the sintered body does not necessarily need to be a hexahedron such as a cube and a rectangular parallelepiped. The planar shape of the sintered body may be a polygon other than a rectangular shape, and may be a circular shape or an elliptical shape. The sintered body may be a polyhedron other than the hexahedron, and the sintered body may have a shape with a rounded corner or ridge or a shape with a curved side surface.

In addition, it is needless to say that a modified alloy may be subjected to grain boundary diffusion in the rare-earth magnet produced through the first step and the second step to raise a coercive force.

The invention claimed is:

1. A method of producing a rare-earth magnet, comprising:

accommodating a sintered body, which is obtained by sintering a rare-earth magnet material, in a forming mold which is constituted by upper and lower punches and a die and in which at least one of the upper and lower punches is slidable in a hollow inside of the die, and producing a rare-earth magnet precursor by performing a first hot working in which, in two side surfaces of the sintered body, which are parallel to a pressing direction and are opposite to each other, one side surface is caused to come into contact with an inner surface of the die and is brought to a constrained state to suppress deformation, and the other side surface is not caused to come into contact with the inner surface of the die and is brought to an unconstrained state to permit deformation when upper and lower surfaces of the sintered body are pressed by using the upper and lower punches; and moving the rare-earth magnet precursor in the forming mold, and producing a rare-earth magnet by performing second hot working in which, in two side surfaces of the rare-earth magnet precursor, which are parallel to the pressing direction, a side surface, which is in the unconstrained state in the first hot working, is caused to come into contact with the inner surface of the die and is brought to the constrained state to suppress deformation, and a side surface, which is in the constrained state in the first hot working, is brought to the unconstrained state to permit deformation when upper and lower surfaces of the rare-earth magnet precursor are pressed by using the upper and lower punches.

2. The method according to claim 1, wherein in each of the sintered body and the rare-earth magnet precursor, the side surface, which is brought to the constrained state, is maintained in the constrained state from start to end of pressing.

3. The method according to claim 1, wherein in each of the sintered body and the rare-earth magnet precursor, the side surface, which is to be brought to the constrained state, is not caused to come into contact with the inner surface of the die and is brought to an unconstrained state at an initial stage of pressing, and is caused to come into contact with the inner surface of the die and is brought to the constrained state in a course of the pressing.

4. The method according to claim 1, wherein a shape of the sintered body is a rectangular parallelepiped.

5. The method according to claim 4, wherein in each of the sintered body and the rare-earth magnet precursor, two side surfaces, which are perpendicular to the two side surfaces parallel to the pressing direction, are maintained in a constrained state from start to end of pressing.

* * * * *